US010781545B2

(12) United States Patent
Massey et al.

(10) Patent No.: US 10,781,545 B2
(45) Date of Patent: Sep. 22, 2020

(54) QUILTING TOOL

(71) Applicants: Jerriann Massey, Tyler, TX (US); Rebecca Ann Prior, Henderson, TX (US)

(72) Inventors: Jerriann Massey, Tyler, TX (US); Rebecca Ann Prior, Henderson, TX (US)

(73) Assignee: ANNIE MCHUGS, LLC, Tyler, TX (US)

( * ) Notice: Subject to any disclaimer, the term of this patent is extended or adjusted under 35 U.S.C. 154(b) by 134 days.

(21) Appl. No.: 16/175,679

(22) Filed: Oct. 30, 2018

(65) Prior Publication Data

US 2020/0131680 A1 Apr. 30, 2020

(51) Int. Cl.
*D05B 97/12* (2006.01)
*B25H 7/02* (2006.01)

(52) U.S. Cl.
CPC ..... *D05B 97/12* (2013.01); *B25H 7/02* (2013.01)

(58) Field of Classification Search
CPC . G01B 3/04; G01B 3/004; G01B 1/00; G01B 3/002; G01B 3/14; G01B 3/566; G01B 3/02; G01B 3/1003
USPC ..... 33/562
See application file for complete search history.

(56) References Cited

U.S. PATENT DOCUMENTS 3,154,861 A * 11/1964 Rubenstein ..... A41H 25/00 33/662
4,524,522 A * 6/1985 Perry ..... A41H 3/002 33/11
4,642,896 A * 2/1987 Grimm ..... A41H 3/00 33/17 R
5,141,140 A 8/1992 Moffett-Hall
5,396,713 A * 3/1995 Valdez ..... A63F 9/001 33/562
5,444,920 A 8/1995 Nelson
5,557,996 A * 9/1996 Reber ..... B25H 7/02 30/292
5,579,670 A * 12/1996 McCormick ..... A41H 31/00 33/562
5,791,062 A 8/1998 Walker
6,286,224 B1 * 9/2001 Lewis ..... G01B 3/14 33/512
6,321,458 B1 11/2001 Hess
6,925,724 B2 8/2005 Tandy
6,935,039 B1 * 8/2005 Hess ..... D05B 97/12 33/1 B (Continued)

OTHER PUBLICATIONS

Quilting Tools,, Walmart.com, Sep. 21, 2018.

(Continued)

*Primary Examiner* — Yaritza Guadalupe-McCall
(74) *Attorney, Agent, or Firm* — Timothy R. Krobot

(57) ABSTRACT

The present invention is directed to a quilting tool and method for preparing unique quilt blocks. Advantageously, the inventive quilting tool includes a template with a fabric-marking window. In a preferred embodiment, the quilting tool includes the template, and an insert with a fabric-marking window. Beneficially, layout of fabric windows in multiple fabric pieces is uniform, and there is provided a wide variety of fabric window shapes and sizes useful for applique and reverse applique patterns. In a preferred embodiment, the quilting tool allows a quilt maker to make a unique wheel-and-spokes pattern.

11 Claims, 3 Drawing Sheets

(56) References Cited

U.S. PATENT DOCUMENTS

| | | | | |
|---|---|---|---|---|
| D609,121 | S | 2/2010 | Elias | |
| 7,730,842 | B1 | 6/2010 | Sebrow | |
| 7,882,645 | B2 * | 2/2011 | Boring | D05C 17/00 33/562 |
| 8,186,073 | B2 | 5/2012 | Nethery | |
| 8,408,150 | B1 * | 4/2013 | Ragan | D05B 91/06 112/136 |
| 8,458,918 | B2 * | 6/2013 | Ostberg | B43L 13/205 33/27.03 |
| 9,617,682 | B2 | 4/2017 | Pelland | |
| 2005/0205150 | A1 * | 9/2005 | Jenner | D03D 29/00 139/11 |
| 2006/0283026 | A1 * | 12/2006 | Lockyer | B43L 7/027 33/1 B |
| 2007/0261260 | A1 * | 11/2007 | Loza | A41H 3/002 33/566 |
| 2013/0068148 | A1 * | 3/2013 | Ragan | D05B 91/06 112/475.08 |
| 2014/0315158 | A1 * | 10/2014 | Wischusen, III | A63H 33/16 434/81 |
| 2015/0096643 | A1 * | 4/2015 | Lawrence | D03D 29/00 139/33 |
| 2016/0332294 | A1 * | 11/2016 | Heinz | B25H 7/02 |
| 2020/0131680 | A1 * | 4/2020 | Massey | B25H 7/02 |

OTHER PUBLICATIONS

Schrader, U.S. Appl. No. 29/346,170, issued as U.S. Pat. No. D644,541, selected prosecution history, includes 2 drawing sheets, 5 pp (2010).

* cited by examiner fig.5A.
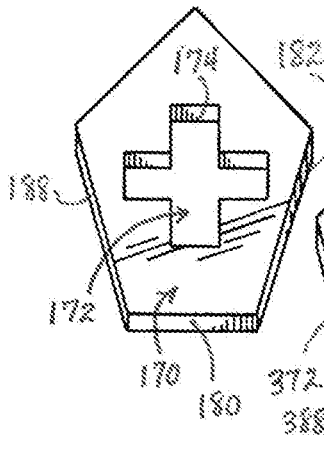
fig.5B.
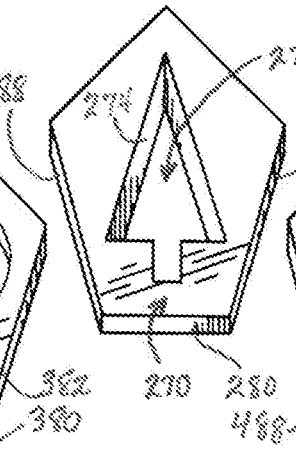
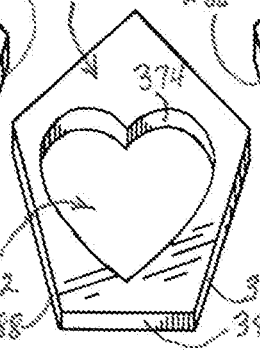
fig.5C.
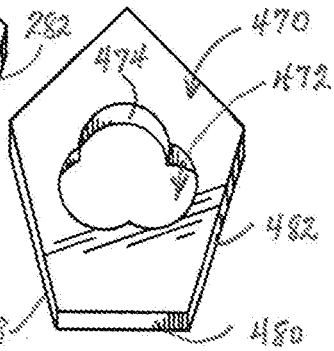
fig.5D.
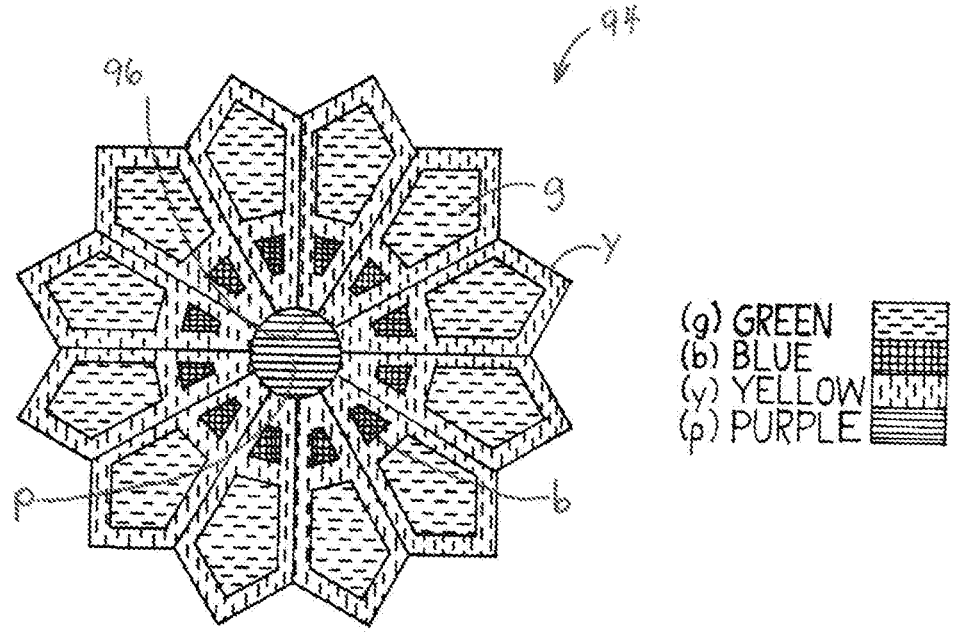
fig. 6.

QUILTING TOOL

FIELD OF THE INVENTION

The present invention relates to quilt making.

BACKGROUND OF THE INVENTION

Quilt making using multiple fabrics of differing colors and patterns and arranging them in different patterns is a well-known skill and art. Quilts are typically made of three layers: the top, the back and a middle layer of batting (made from fibers of cotton, polyester, silk, etc. used to provide warmth in quilts). The top layer is typically the most decorative side and is made using many pieces of fabric stitched together.

The most common unit of quilting is called a block, generally multiple pieces of fabric sewn together to form a shape or pattern. Blocks are "pieced" (sewn) together either by hand or machine.

After the desired number of blocks is completed, the blocks are stitched together to form a quilt top. Then the quilt top, batting and back are sewn together with stitches that penetrate all three layers resulting in the layers being definitively merged together.

A quilt block that has been popular since the 1920's is a circular quilt block called a Dresden Plate block. The Dresden Plate is characterized by a radiating blade or petal pattern. A Dresden Plate uses from 12 to 24 blades or petals to form a circular pattern. Patterns for Dresden Plate blades/petals are available in books, magazines and online. As practiced, a Dresden Plate is appliqued to a background fabric, without further embellishment, to create a Dresden Plate block, also known as a Dresden block.

Because the Dresden Plate pattern is a circle, each blade/petal must be accurately designed so that total number of blades and the degree of the arcs equal 3600. Illustrative are 15, 18 and 22.5 degrees of arc.

The most common length of each blade/petal ranges from 2 inches to 8 inches resulting in multiple finished sizes of the quilt block. Many of the finished sizes of the quilt block are between 8 and 12 inches in diameter.

The outer edge of a Dresden Plate pattern can be finished in multiple ways. Many are curved (like a flower petal), some are pointed, and others have a smooth, outer curved edge.

A distinguishing characteristic of the Dresden Plate pattern is that the fabric pieces do not intersect in the center of the circular pattern. This eliminates problems related to the difficulty of joining too many fabric pieces at one intersection.

Making a quilt using, for example, Dresden Plate blocks for a bed that measures 84 inches by 96 inches (a common size for a queen bed), could require 56 Dresden Plate units. If each unit has 12 blades/petals, that would result in 672 individually cut blades/petals. Clearly, accuracy in cutting and sewing together of the individual blades/petals is imperative for symmetry and consistency of a Dresden Plate quilt.

Quilting ruler/templates are planar and commonly made of plastic, for example, an acrylic plastic. Illustrative quilting templates and methods are exemplified by U.S. Pat. No. 6,321,458 to Hess and U.S. Pat. No. 8,186,073 to Nethery, and U.S. Pat. No. 5,791,062 to Walker. Nethery and Hess are directed to cutting out fabric shapes. Hess describes a panel with cutting slots and stitching slots. Nethery describes a quilting template and ruler with sewing slots and cutting slots.

Also known in quilt making as exemplified by U.S. Pat. No. 5,141,140 to Moffett-Hall, are apparatus for making appliques. Moffett-Hall describes a shape plate provided with an opening for receiving applique fabric and a template formed in the same shape as the opening. In making the applique, the template is placed on fabric and the applique shape traced onto the fabric.

Despite improvements in quilt making, there remains a need for a quilt making tool that provides for a new level of artistic interest, increased embellishment and unique quilt patterns.

SUMMARY OF THE INVENTION

It is accordingly an objective of the present invention to provide a quilt making tool that provides for a new level of artistic interest, increased embellishment and unique quilt patterns, for instance, for making Dresden Plate units having unique patterns.

To achieve the foregoing objectives and in accordance with the purpose of the present invention, as embodied and broadly described herein, there is provided a unique quilting tool useful for cutting and marking fabric. The inventive quilting tool is based upon a quilting template provided with one or more fabric-marking windows therein. The exterior edges of the template provide a fabric cutting guide for the shape and dimensions of each fabric piece.

Each fabric-marking window is advantageously located in a selected position within the template perimeter and has a selected shape and dimensions for uniformly marking each fabric piece so that layout of fabric windows in multiple fabric pieces is uniform, and structural integrity of the resulting fabric pieces is maintained. Beneficially, fabric pieces cut using the template may include appliques in registration with fabric windows corresponding to the template window. The appliques may be reverse appliques.

Beneficially, the template is transparent, and bears template/fabric positioning guide lines. Illustrative guide lines are seam allowance guide lines.

In a preferred embodiment, the template is provided with a pair of fabric-marking windows spaced apart from one other by a bridge. To form a unique wheel-and-spokes quilt pattern, the template shape has two exterior edges that form the sides of an acute angle. A trapezoid illustrates this particular template shape, and useful shapes for a pair of fabric-marking windows are a pentagon and trapezoid.

Beneficially, the inventive quilting tool may include an insert provided with a fabric-marking window therein located in a selected position within the insert perimeter and having a selected shape and dimensions for uniformly marking each fabric piece. As a result, as in the case of a template window, layout of corresponding fabric windows in multiple fabric pieces is uniform, and structural integrity of the resulting fabric pieces is maintained. The insert has an exterior shape and dimensions configured to be snugly, yet removably, received within a template window. When assembled in a snug mating fit, the insert window is a window within a window. The insert window advantageously differs in shape, size or both from the shape of the mating window of the template.

Also, in accordance with the invention, there is provided a method of making a quilt block using the inventive quilting tool. The method is set forth in the below detailed description. Features of the method include positioning the template on a layer of fabric, taking into account in the positioning, the relationship of the fabric pattern and of advantageous template/fabric positioning lines. Then, in either order, the outline of a fabric-marking window is marked on an underlying fabric layer, and the edges of the template are used as a guide to cut the underlying fabric preferably with a rotary cutter. Thereafter, using the outline of a template window marked on the fabric, fabric within the window outline is cut out, leaving a seam allowance within the outline to make a fabric window with finished edges that are folded and correspond to the window outline.

The template window may also be used to cut out a reverse applique for a fabric window made using the template window. To this end, the template is positioned on a layer of another fabric, and the outline of the template window is marked on that fabric, and then a piece of that fabric is cut out adding a seam allowance outside the outline of the template window. To use the cut-out piece of fabric as a reverse applique, the cut-out piece of fabric is positioned behind, and in registration with, the fabric window so as to be viewable through the fabric window, and is stitched into place. Typically, after finishing the work on each fabric piece, the fabric pieces are stitched together to make a quilt block.

The same approach may be used with an insert received within a fabric-marking window of the template, that provides a window within a window as previously described. The same approach may also be used to make a unique wheel-and-spokes quilt pattern.

Additional advantages and beneficial features of the present invention are set forth in the drawing and detailed description, and in part will become apparent to those skilled in the art upon examination of the drawing and detailed description or may be learned by practice of the invention. As will be realized, this invention is capable of other and different embodiments than those described, and its several details are capable of modification in various respects, all without departing from the invention. Accordingly, the drawing and the detailed description are to be regarded as illustrative in nature, and not as restrictive.

BRIEF DESCRIPTION OF THE DRAWING

Reference now is made to the accompanying drawing which forms a part of the specification of the present invention. For clarity, several template/fabric positioning guide lines have been omitted from FIGS. 2-4.

FIGS. 5A-5D are perspective views of several inserts useful with the template of FIG. 1; and FIG. 6 illustrates, in reduced scale, a unique wheel-and-spokes quilt pattern that may be made using the template of FIG. 1.

DETAILED DESCRIPTION OF THE INVENTION

Figure 1:
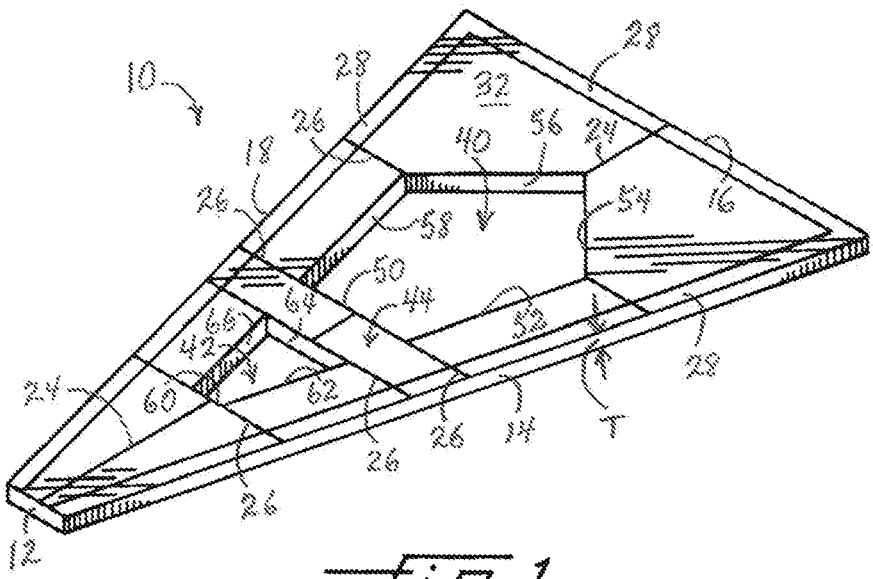
FIG. 1 is a perspective view of a preferred embodiment of a quilting template in accordance with the present invention.

In the description of the invention, relative terms such as "attic" and "basement" and the like, have been used particularly with reference to the drawing to assist understanding.

Definitions of the following terms used in this description, are as follows:

Perimeter: the boundary of a closed plane figure.

Quilt Block: a basic unit of a quilt. Generally, many blocks sewn together make a quilt top.

Applique: In quilting, a technique in which a piece(s) of fabric is sewn onto the top of another piece of fabric. This can be done by hand or by sewing machine.

Reverse Applique: In quilting, a technique in which a piece(s) of fabric is sewn behind a finished opening in another piece of fabric. This can be done by hand or by sewing machine.

This invention provides a quilting tool and method for preparation of consistently sized and shaped fabric pieces. It allows a quiltmaker to accurately cut layers of fabric with precision using a rotary cutter. The quilting tool provides for the dimensions and accurate geometric shape of each fabric piece, as well as allows a quiltmaker to mark each fabric piece with one or more windows. Windows of the tool allow a quiltmaker to position and accurately mark the position of fabric windows in a predetermined position and with a predetermined shape and dimensions repeatedly on multiple fabric pieces, so that layout of the fabric windows in multiple fabric pieces is uniform. The resulting fabric pieces when assembled, create a quilt unit with uniformly positioned and shaped fabric windows. The windows allow a quiltmaker to choose a piece of fabric to be used as a reverse applique piece (called fussy cutting) that includes a specific pattern or motif. This artistic embellishment is a novel and unique enhancement for making circular quilt patterns, in particular Dresden Plate patterns.

As now described, the inventive quilting tool includes a template, and in one inventive aspect, an insert provided with a fabric-marking window. Referring to FIG. 1, a preferred embodiment of a quilting tool in accordance with the present invention, includes a template 10 that has four exterior edges 12, 14, 16, 18 that form the perimeter of the template and provide a fabric cutting guide for the shape and dimensions of each fabric piece. Opposing side edges 14, 18 are beneficially rectilinear and typically the same length, but may be different lengths depending on the pattern desired. Bottom edge 12 is conveniently rectilinear. Top edge 16 may be rectilinear, as shown, or curvilinear, and may be formed by two or more edges, as may be seen by reference to the quilt pattern of FIG. 6.

As illustrated, edges 14,18 of template 10 have an angular relationship to each other and form the sides of an acute angle, and template 10 has the shape of a trapezoid, in particular a truncated isosceles triangle. This shape is useful for making circular quilt patterns. Other template shapes may be used depending upon the desired quilt block pattern. Illustrative are template shapes that include parallel rectilinear side edges such as a rectangular template shape. Regardless of the desired quilt block pattern, the exterior template edges are beneficial as a fabric cutting guide.

For making a circular quilt block, a template in accordance with the present invention, comprises the exact degrees of arc for the number of blades/petals used to make the quilt block. A variety of template sizes and of degrees of arc are useful. FIG. 1 represents a template having a thirty degree arc, and as shown by the circular pattern of FIG. 6, twelve blades are used to make the pattern. For a 22.5 degree arc, sixteen blades are used, for an 18 degree arc, twenty blades are used, and for a 15 degree arc, twenty-four blades are used. Sizes of illustrative quilt blocks may finish at 11 inches in diameter, at 15 inches in diameter and at 23 inches in diameter. Depending upon the objectives of the quilt-maker, the circle may be incomplete, for example, it may be semicircular or a quarter of a circle.

With continued reference to FIG. 1, template 10 beneficially includes fabric alignment guide lines, for template/fabric alignment. Illustrative are a vertical fabric alignment line 24, and generally perpendicular thereto, horizontal fabric alignment lines 26, all printed (for instance, by screen printing) or otherwise indicated, on a facing surface 32 of the template, which is conveniently planar. As illustrated, vertical alignment line 24 is generally perpendicular to exterior edge 12, as well as to exterior edge 16. Likewise printed or otherwise indicated on facing surface 32 are seam allowance guide lines 28, which are located interior to, and spaced from, the exterior edges, for example, ¼" from an exterior edge. Opposite to facing surface 32 of the template is a fabric-contacting surface (not shown).

Consistent with usefulness of the fabric positioning guide lines, the template is beneficially made of a transparent material, such as a transparent acrylic plastic. A useful thickness "T" (indicated in FIG. 1) of the template is in the range of ⅛ to ½ inch. Templates of varying size may be used depending on the size of the desired quilt pattern or other quilting considerations. If desired, the template may include ruler markings along one or more edges.

A template in accordance with the invention, includes a window located within the borders of the template and having a shape and dimensions that enable a quilt maker to uniformly mark a predetermined position, and predetermined shape and dimensions of the template window on each fabric piece. As a result, the layout of corresponding fabric windows is uniform in multiple fabric pieces. Furthermore, the position, shape and dimensions of a template window are selected to maintain structural integrity of the resulting fabric pieces. To this end, a template window is not, for example, overly large, or located too closely to an adjacent template edge. Rather, a template window is typically proportionally sized to a particular template size, and is appropriately spaced apart from adjacent template edges, typically one-half to one inch or more depending on the template size and shape, and the window size and shape.

As illustrated and with continued reference to FIG. 1, template 10 is provided with two such fabric-marking windows: an attic window 40 and a basement window 42 separated by a bridge 44. In this advantageous embodiment, template 10 may be used to mark the outline of either or both of windows 40, 42. It also may be used to mark the outline of a single window by outlining the side and top edges of the attic window, and the side and bottom edges of the basement window, and then repositioning the template to connect the broken lines using a long template edge.

Interior rectilinear edges 50, 52, 54, 56, 58 of window 40 are located within the borders of the template, and beneficially define the shape of a pentagon, and form the interior wall of the pentagon. Interior rectilinear edges 60, 62, 64, 66 of window 42 are located within the borders of the template, and beneficially define the shape of a trapezoid, and form the interior wall of the trapezoid. Edges 60, 64 of the trapezoid are parallel to one another. For making a wheel-and-spokes quilt pattern, interior window edges 52, 62 are beneficially generally parallel to exterior edge 14, and interior window edges 58, 66 are beneficially generally parallel to exterior edge 18.

As illustrated, edge 50 of bridge 44 may be longer than edge 64. This relationship may differ, but in any event may relate to the template shape as well as other factors including the relative size of the related fabric-marking windows. Similarly, the width of bridge 44 relates to the spacing between the pair of fabric-marking windows, and to structural integrity of the resulting fabric piece. In brief, the length and width dimensions of the bridge relate in part to the geometry of, and the spaced apart relationship of, the pair of windows.

Template 10 may be provided with only one fabric-marking window therein, or, if desired, more than two fabric-marking windows. Template 10 without bridge 44, is illustrative of a template with one fabric-marking window. The template window or windows may have a wide variety of useful shapes other than the pentagonal and trapezoidal shapes illustrated, for example, hexagonal, rectangular, square or triangular. However, interior window edges 50, 64, which define the two edges of bridge 44, are beneficially rectilinear. Otherwise, any visually pleasing or artistic quilting shape or shapes may be used for the template window or windows.

Referring again to the circular pattern of FIG. 6, the template illustrated in FIG. 1 is useful for making the illustrated wheel-and-spokes pattern. To this end, the template has a shape wherein two of the exterior template edges form the sides of an acute angle, and the template is provided with a pair of fabric-marking windows separated by a bridge, and each of the windows has a shape wherein interior window edges 52,62 are generally parallel to exterior edge 14, and interior window edges 58,66 are generally parallel to exterior edge 18.

Figure 3:
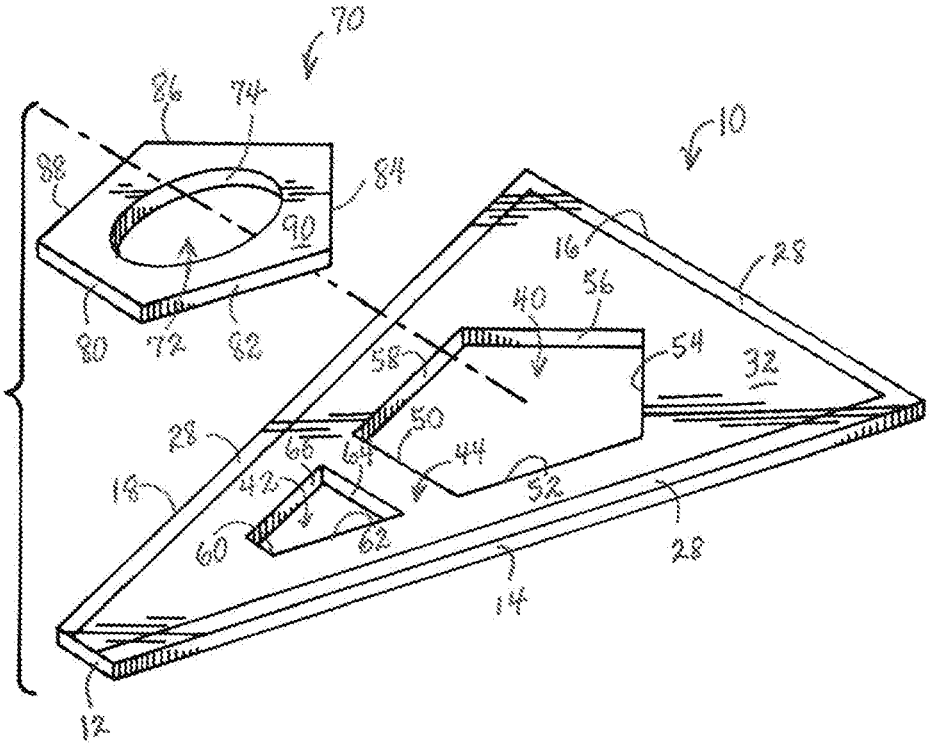
FIG. 3 is an exploded view of the template and insert of FIG. 2.
Figure 2:
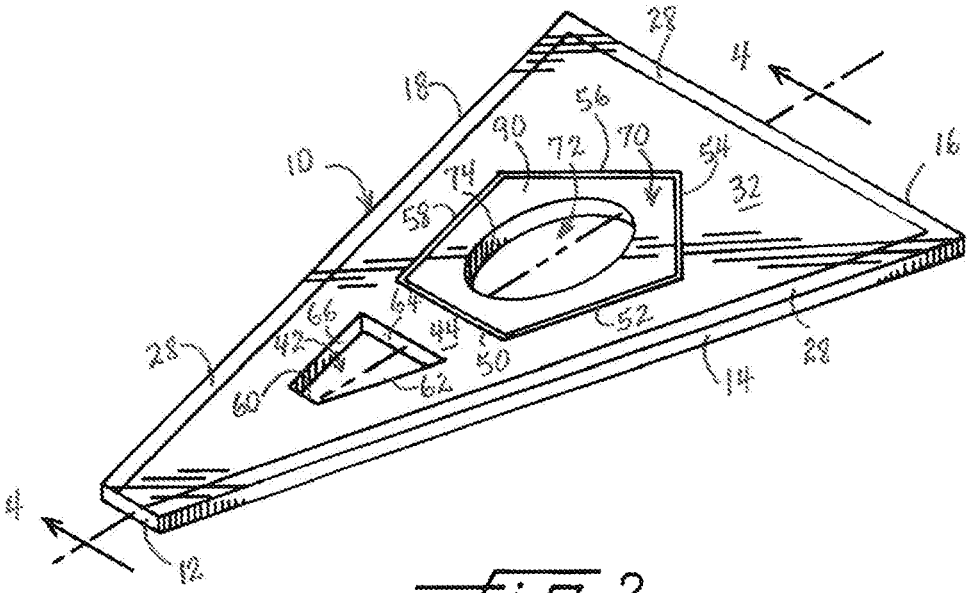
FIG. 2 is a perspective view of the template of FIG. 1, showing an insert in snug mating fit within the upper window of the template of FIG. 1.
Figure 4:
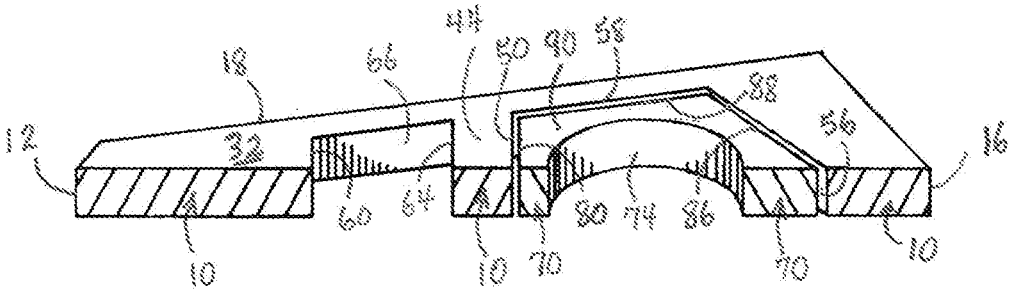
FIG. 4 is a cross-sectional view taken generally along line 4-4 of FIG. 2, with the cross-section enlarged in thickness, and the spacing between the exterior wall of the insert and the interior wall of the insert-receiving template window, exaggerated for clarity.

Referring now to FIGS. 2-4, and with respect to another inventive aspect, the inventive quilting tool includes an insert 70 provided with a fabric-marking window 72 therein. Like template 10, an insert in accordance with the invention, includes a fabric-marking window located within the insert perimeter and having a shape and dimensions for uniformly outlining the position, shape and dimensions of the fabric-marking window on each fabric piece. As a result, the layout of corresponding fabric windows is uniform in multiple fabric pieces.

Insert 70 has an exterior shape and dimensions configured to be snugly received within a template window, for example, as illustrated, within template window 40. In this respect, exterior edges 80, 82, 84, 86, 88 of insert 70 define a shape that provides for a mating fit with the shape of template window 40, and form a perimeter wall that snugly, yet removably, fits within the template window. The resulting tight fit holds the insert in place in use. As illustrated, window 72 has a generally circular interior wall 74.

Also, like template 10, insert 70 has a facing surface 90 and opposite to surface 90, a fabric-contacting surface (not shown). Beneficially, the insert has a thickness that corresponds to the template thickness, so that when the insert is received within the template window, the fabric-contacting surfaces of the template and of the insert contact the fabric, thereby benefiting marking of an underlying fabric with the insert window shape and dimensions.

Alternatively, or in addition, template window 42 may be used to receive an insert of corresponding shape and appropriate dimensions.

Referring also to FIGS. 5A to 5D, the shape and dimensions of an insert window may vary widely depending upon design considerations. For brevity, like features of the inserts of FIGS. 5A to 5D are correspondingly numbered with reference to insert 70.

As illustrated, the shape of an insert window may be circular (insert 70, FIG. 3), or the shape of an insert window may represent a plus sign (insert 170, fabric-marking window 172, FIG. 5A), or a tree (insert 270, fabric-marking window 272, FIG. 5B), or a heart (insert 370, fabric-marking window 372, FIG. 5C) or a three leaf clover (insert 470, fabric-marking window 472, FIG. 5D), or may be other desired shapes, or may be a blank, that is, block out a template window. Thus, as in the case of a template window, a wide variety of fabric-marking windows may be selected from, for creating variation in the size and shapes of fabric windows.

Referring again to circular pattern of FIG. 6, which is an embellished Dresden Plate pattern, the primary fabric of quilt unit 94 is yellow (indicated by "y"), and the windows made using attic windows 40 are reverse appliqued using a green fabric (indicated by "g"), the windows made using basement windows 42 are reverse appliqued using a blue fabric (indicated by "b"), and a central aperture 96 of the quilt pattern is appliqued using a purple fabric (indicated by "p").

With reference also to FIG. 1, a preferred method of making a circular quilt unit having a wheel-and-spokes pattern as illustrated by FIG. 6, is described. Template 10 is positioned on a layer of yellow fabric. Then, in either order, the outlines of windows 40 and 42 are marked on the underlying fabric layer, and the edges of the template are used as a guide to cut the fabric preferably with a rotary cutter. Thereafter, using the outlines of windows 40 and 42 marked on the fabric, fabric within the window outlines is cut out, leaving a seam allowance within the outlines to provide the fabric windows with finished edges that are folded and correspond to the window outlines.

Then, for example, template window 40 may be used to make a reverse applique for a fabric window made using template window 40, as follows: Template 10 is positioned on a layer of a different fabric (in this case, a green fabric), and the outline of window 40 is marked on the green fabric, and then using the outline, a piece of green fabric is cut out adding a seam allowance outside the outline of template window 40. The same technique may be used to make a reverse applique for a fabric window made using template window 42. The two reverse appliques are positioned behind, so as to be in registration with and viewable through, the respective windows, and stitched into place.

These procedures, in the case of a 30 degree arc, are repeated to make twelve identical fabric pieces each with two identically positioned, sized and shaped fabric windows, with two reverse appliques stitched into place. Afterwards, an edge of one fabric piece is stitched to an edge of another fabric piece, and this process is repeated until the circular wheel-and-spokes quilt pattern is made.

Referring again to FIGS. 2-4, and to make a circular quilt pattern, insert 70 is placed within upper window 40. As described, interior edges of window 40 and the exterior edges of insert 70 are shaped for snug mating fit of the insert within the template window, so that the insert is firmly held in place. The foregoing process is followed except that the circular outline of fabric-marking window 72 is used to mark an underlying fabric layer, instead of using the pentagonal outline of template window 40. The insert may be conveniently removed from its snug mating fit with window 40 by inserting a finger through window 72, which is typically large enough for that, and pulling on the insert.

Using, for example, a square template with a pair of fabric-marking windows separated by a bridge, or with only one window, the above procedure is followed except that the number of fabric pieces to be sewed together will vary depending on the desired size of the quilt block.

If preferred, multiple fabric pieces may be cut out using an inventive template, and then each fabric piece marked with one or more fabric-marking template windows prior to cutting out fabric within the window outlines.

Various modifications and combinations have been described; other modifications will be readily apparent to a skilled quilt maker. The present invention may be carried out with other modifications and/or combinations without departing from the spirit or essential attributes thereof. Accordingly, reference should be made to the appended claims as indicating the scope of the invention.

The invention claimed is:

1. A quilting tool for cutting out fabric pieces, said quilting tool comprising a template provided with at least one fabric-marking window therein, wherein said template has four or more exterior edges providing a fabric cutting guide for the shape and dimensions of each fabric piece, and wherein each fabric-marking window is located within the template perimeter and has a shape and dimensions adapted for uniformly outlining a predetermined position and predetermined shape and dimensions of the fabric-marking window on each fabric piece wherein structural integrity of a plurality of fabric pieces each provided with at least one window therein that corresponds to said outlining, is maintained, and layout of the fabric windows is uniform in said plurality of fabric pieces, wherein said template comprises a first fabric-marking window and a second fabric-marking window spaced apart from one other by a bridge, and wherein two of the exterior edges of the template have an angular relationship to each other and the angle is an acute angle.

2. The quilting tool of claim 1, wherein an edge of said first fabric-marking window and an edge of said second fabric-marking window are generally parallel to one of the acute angle-forming edges of the template, and another edge of said first fabric-marking window and another edge of said second fabric-marking window is generally parallel to the other of the acute angle-forming edges of the template, wherein a circular quilt block assembled from a plurality of fabric pieces made using the template, has a wheel-and-spokes pattern.

3. The quilting tool of claim 2, wherein a fabric piece forming the circular quilt block, comprises a pair of appliques in registration with the pair of fabric windows corresponding to said first fabric-marking window and said second fabric-marking window.

4. The quilting tool of claim 3, wherein the appliques are viewable through the fabric windows.

5. The quilting tool of claim 1, wherein said template has the shape of a trapezoid.

6. The quilting tool of claim 1, wherein said first fabric-marking window has the shape of a pentagon and said second fabric-marking window has the shape of a trapezoid.

7. The quilting tool of claim 1, wherein interior to, and spaced from, the exterior edges, said template bears fabric positioning guide lines, and said template is transparent.

8. A quilting tool for cutting out fabric pieces, said quilting tool comprising a template provided with at least one fabric-marking window therein, wherein said template has four or more exterior edges providing a fabric cutting guide for the shape and dimensions of each fabric piece, and wherein each fabric-marking window is located within the template perimeter and has a shape and dimensions adapted for uniformly outlining a predetermined position and predetermined shape and dimensions of the fabric-marking window on each fabric piece wherein structural integrity of a plurality of fabric pieces each provided with at least one window therein that corresponds to said outlining, is maintained, and layout of the fabric windows is uniform in said plurality of fabric pieces, wherein said tool further comprises an insert provided with a fabric-marking window located within the insert perimeter and having a shape and dimensions adapted for uniformly outlining the position, shape and dimensions of the insert fabric-marking window on each fabric piece wherein layout of corresponding windows in a plurality of fabric pieces is uniform.

9. The quilting tool of claim 8, wherein said insert has an exterior shape and dimensions configured to be snugly, yet removably, received within a fabric-marking window of said template.

10. The quilting tool of claim 9, wherein the insert window is a window within a window, and differs in shape, size or both from the shape of the receiving template window.

11. The quilting tool of claim 10, wherein said window within a window has a different shape than the shape of the receiving template window.

* * * * *